US009648917B2

(12) United States Patent
Griffith

(10) Patent No.: US 9,648,917 B2
(45) Date of Patent: May 16, 2017

(54) DETACHABLE CLOTHING

(71) Applicant: Jeoaux P. Griffith, Corona, CA (US)

(72) Inventor: Jeoaux P. Griffith, Corona, CA (US)

(73) Assignee: JEOAUX LLC, Corona, CA (US)

( * ) Notice: Subject to any disclaimer, the term of this patent is extended or adjusted under 35 U.S.C. 154(b) by 0 days.

(21) Appl. No.: 14/720,665

(22) Filed: May 22, 2015

(65) Prior Publication Data

US 2016/0338432 A1 Nov. 24, 2016

(51) Int. Cl.

| | |
|---|---|
| ***A41D 1/14*** | (2006.01) |
| ***A41D 1/04*** | (2006.01) |
| ***A41D 27/00*** | (2006.01) |
| ***A41D 11/00*** | (2006.01) |
| ***A41D 1/08*** | (2006.01) |

(52) U.S. Cl.

CPC ..... *A41D 27/00* (2013.01); *A41D 1/04* (2013.01); *A41D 1/08* (2013.01); *A41D 1/14* (2013.01); *A41D 11/00* (2013.01)

(58) Field of Classification Search

CPC ..... A41D 27/00; A41D 15/00; A41D 15/002; A41D 15/005; A41D 15/007; A41D 1/22

USPC ..... 2/69, 211

See application file for complete search history.

(56) References Cited

U.S. PATENT DOCUMENTS

| | | | | | |
|---|---|---|---|---|---|
| 459,106 | A * | 9/1891 | Fifield | A41D 15/00 | 2/114 |
| 1,037,514 | A * | 9/1912 | O'Connor | A41D 1/14 | 2/211 |
| 1,076,124 | A * | 10/1913 | Juda | A41D 1/14 | 2/211 |
| 2,297,159 | A * | 9/1942 | Mohler | A41D 1/20 | 2/76 |

(Continued)

FOREIGN PATENT DOCUMENTS

| | | |
|---|---|---|
| DE | 29612814 U1 | 9/1996 |
| FR | 7824399 | 3/1980 |
| WO | WO 02/32244 A1 | 4/2002 |

OTHER PUBLICATIONS

Ecouterre, "Dutch Designers' Modular "Refinity" Clothing Is Like Legos for Fashion." Published by website Flavorwire on Nov. 13, 2009, 3 pages. Retrieved from http://flavorwire.com/50321/dutch-designers-modular-refinity-clothing-is-like-legos-for-fashion on Feb. 25, 2015.

(Continued)

*Primary Examiner* — Katherine Moran

(74) *Attorney, Agent, or Firm* — Lewis Roca Rothgerber Christie LLP; Oliver Bajracharya; Sami I. Schilly

(57) ABSTRACT

A detachable garment includes a front panel and a back panel. The front panel includes a first outer edge opposite to a second outer edge, a first side having a first pattern, a second side having a second pattern, and a fastener located near the first outer edge and the second outer edge. The back (Continued)

panel includes a third outer edge opposite to a fourth outer edge, a third side having a third pattern, a fourth side having a fourth pattern, and a complementary fastener configured to mate with the fastener and located near the third outer edge and the fourth outer edge. A width of the back panel is greater than a width of the front panel. The third and fourth outer edges are each configured to fold over a portion of the back panel to mate the complementary fastener with a respective fastener on the front panel.

20 Claims, 9 Drawing Sheets

(56) References Cited

U.S. PATENT DOCUMENTS 2,479,091 A * 8/1949 Ackley ..... A41D 15/00 2/74
2,747,197 A * 5/1956 Bailey ..... A41D 1/14 2/211
2,965,904 A * 12/1960 Johnson ..... A41D 1/14 2/211
3,064,265 A * 11/1962 Bridgewaters ..... A41D 15/002 2/105
3,116,491 A * 1/1964 Previdi ..... A41D 1/20 2/102
4,683,595 A * 8/1987 Cash ..... A41D 15/00 2/105
5,315,716 A * 5/1994 Baum ..... A41D 1/06 2/114
5,628,064 A 5/1997 Chung
5,774,892 A * 7/1998 Tisdale ..... A41D 1/06 2/115
5,894,600 A 4/1999 Chénefront
8,272,072 B1 * 9/2012 Fowler ..... A41D 15/00 2/263
2006/0048262 A1 * 3/2006 Sencion ..... A41D 15/005 2/69
2009/0064919 A1 * 3/2009 Greenwald ..... G08B 13/246 116/201
2009/0300822 A1 * 12/2009 Johnson ..... A41D 15/00 2/221
2012/0023643 A1 2/2012 O'Connell
2012/0317700 A1 * 12/2012 Vanderburgh ..... A41D 1/06 2/237
2012/0324617 A1 * 12/2012 Lekkas ..... A41D 1/22 2/74
2014/0259299 A1 * 9/2014 Sievwright ..... A41D 27/20 2/252

OTHER PUBLICATIONS

"New designs for women . . . " Published by web blog Young. Mobile.Social on Jan. 13, 2012, 3 pages. Retrieved from http://youngmobilesocial.blogspot.com/2012_01_01_archive.html on Feb. 25, 2015.

* cited by examiner

DETACHABLE CLOTHING

BACKGROUND

1. Field

The present disclosure relates to clothing.

2. Description of the Related Art

Currently, most articles of clothing produced and sold commercially are designed and constructed as one piece, providing the purchaser or wearer the option of one aesthetic look for any particular garment. Permanently sewn seams hold the garment together, allowing for stabilization and wearability of the garment. However, these permanent seams limit the ability of a user to modify the appearance of the garment without mutilating or damaging the garment.

Some articles of clothing may be reversible, enabling the user an added option of two distinct aesthetic looks by providing the flexibility to wear the garment on either side. However, permanently sewn seams (e.g., sewn seams connecting a front panel and a back panel) are still incorporated to hold the reversible garment together in both configurations, and the garment is typically reversed about the permanent sewn seams.

As such, current clothing designs and construction fail to provide greater versatility than two aesthetic looks for most garments. Accordingly, there is a need for a clothing design that incorporates a single-side design and a reversible design and also provides for further modification of the aesthetic features of the garment without mutilating or destroying the garment.

Further, most articles of clothing currently produced and sold commercially are designed as one specific size. As an adult or child grows or otherwise changes measurements, the wearer must typically purchase and wear a garment of a different size. Accordingly, there is a need for a clothing design and construction that allows for size alteration, whereby a separate finished component of same-kind can be purchased and the previously utilized component piece may be substituted or replaced to account for the wearer's change in size.

SUMMARY

One or more embodiments of the present disclosure are directed to separate component pieces that can be flipped, reversed, interchanged and/or substituted in place of another component piece by using separate pieces of the same or similar design and construction type. As such, each component piece is designed for use in a particular garment and is designed to mate with one or more particular complementary component pieces.

One or more embodiments of the present disclosure allow for a variety of uses for articles of clothing by providing the capability of detaching and flipping or reversing various component pieces such that any assembled garment may assume a plurality of aesthetic states. Each distinct component is capable of being detached and substituted or switched in place of another distinct component having the same shape, thus allowing the size and/or appearance of the garment to be altered by interchanging one component with another component of the same general shape.

One or more embodiments of the present disclosure also allow for size (or growth) alteration. For example, if a component in an assembled garment is too small or too big for the wearer, a separate finished component of same-kind (i.e., having the same general shape but of a larger or smaller size) can be purchased and the component pieces may be substituted or replaced, creating a finished garment of a different size.

BRIEF DESCRIPTION OF THE DRAWINGS

These and other features and aspects of embodiments of the present disclosure will be better understood by reference to the following detailed description, when considered in conjunction with the accompanying figures. The same numbers are used throughout the figures to reference like features and components.

DETAILED DESCRIPTION

Figure 1B:
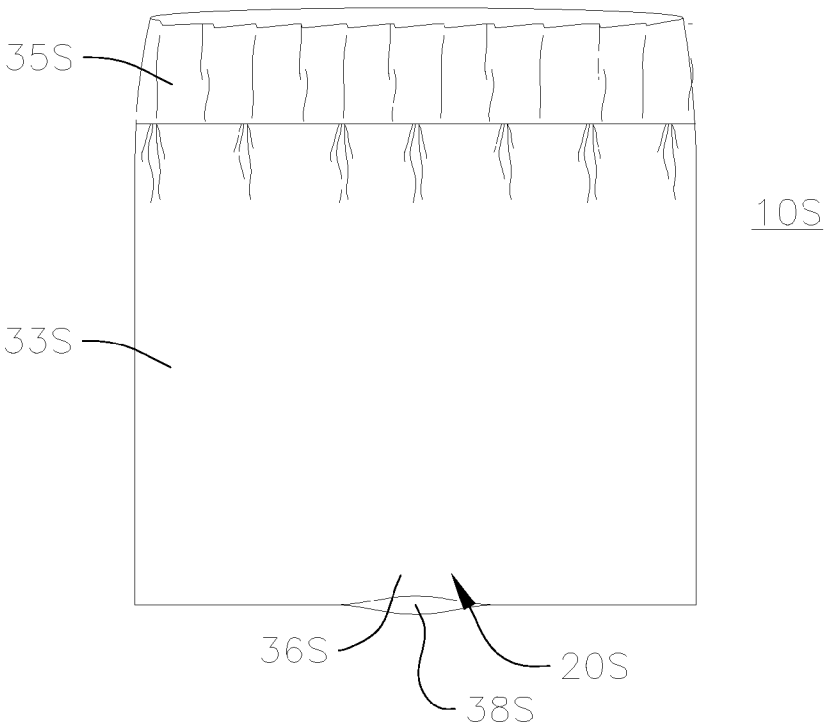
FIG. 1B is a back elevation view of a skirt according to one or more embodiments of the present disclosure.

The present disclosure relates to a garment having a plurality of panels that may be fitted together to create a wearable garment. The drawings depict some example embodiments as applied to a garment for illustrative purposes only, and it will be apparent that modifications may be made without departing from the spirit and scope of the invention, and also that the present disclosure may also be used in other applications in the same or similar fields. Although relative terms such as "first," "second," "top," "bottom," "front," "rear," "left" and "right" and similar terms have been used herein to describe relative spatial relationships between elements, it is to be understood that these terms are intended to encompass different orientations of the various elements and components of the device in addition to the orientation depicted in the figures. Moreover, the figures contained in this application are not necessarily drawn to scale and various features may be exaggerated.

Although reference is made herein to specific garments, such as a skirt, a vest, a dress, and a pair of shorts, it will be appreciated by one of ordinary skill in the art that the present invention is not limited thereto, and may be applied to a variety of different garments or articles of clothing. For example, the inventive concept may be applied to other garments, including, but not limited to, shirts, jackets, pants, etc. Further, the dimensions of the garments may be significantly altered. For example, the inventive concept may be applied to a mini skirt, a maxi skirt, a knee-length skirt, an A-line skirt, etc. without departing from the spirit and scope of the invention. However, for ease of description, reference is made herein to example embodiments as applied to specific garments, including reference to a skirt, a vest, a dress and shorts.

Referring now to an example embodiment illustrated in FIGS. 1A, 1B, 2A, 2B, 4A, 4B, 5A and 5B, a skirt 10S includes a front panel 20S and a back panel 30S. The front panel 20S includes a fastener 40 and the back panel includes a complementary fastener 45. The fastener 40 on the front panel 20S may be mated with the complementary fastener 45 on the back panel 30S to form an assembled and wearable skirt 10S.

The front panel 20S may have a length L1 in the length direction and a width W1 in the width direction. The back panel 30S may similarly have a length L2 in a length direction and a width W2 in a width direction. The fasteners 40 and 45 may extend in the length direction of the front panel 20S and back panel 30S, respectively. In some embodiments, the length L1 of the front panel 20S and the length L2 of the back panel 30S may be equal or substantially equal. In other embodiments, the length L1 of the front panel 20S may be greater than or less than the length L2 of the back panel 30S, creating a unique, uneven design when the front panel 20S and the back panel 30S are assembled together. In some embodiments, the lengths L1 and L2 of the panels may be variable, i.e., may be non-uniform, allowing for construction of an asymmetrical hem line when the front panel 20S and back panel 30S are assembled together. In some embodiments, the width W2 of the back panel 30S may be greater than the width W1 of the front panel 20S. As such, a portion of the back panel 30S may be folded or wrapped around an adjacent portion of the back panel 30S, as illustrated in FIG. 1A. Accordingly, from a front view perspective, a first edge portion 31S (e.g., a left edge) of the back panel 30S, the front panel 20S, and a second edge portion 32S (e.g., a right edge) of the back panel 30S may be visible. Similarly, from a rear view perspective, a middle portion 33S of the back panel 30S may be visible.

Once a user has determined his or her measurements, the user may then select the desired proportion of front panel 20S to back panel 30S. For example, if the user desires to have a skirt 10S that is 90% one pattern and 10% another pattern, the user may select a back panel 30S with a width W2 corresponding to approximately 90% of the user's waist circumference. The user may then select a front panel 20S with a width W1 corresponding to approximately 10% of the user's waist circumference (it will be appreciated by one of ordinary skill in the art that a tolerance will be required in selecting the appropriate widths W1 and W2 to ensure the skirt 10S may be worn comfortably while allowing for connection of the fasteners 40 and 45). The user may then assemble the skirt by attaching the left portion 31S to the left side of the front panel 20S and the right portion 32S to the right side of the front panel 20S, creating a completed skirt 10S. As mentioned above, the user will likely select a front panel 20S and a back panel 30S having equal lengths L1 and L2 (or having corresponding lengths L1 and L2 in embodiments having an asymmetrical hemline), such that the bottom hem of the skirt is generally continuous. However, the present invention is not limited thereto, and assembly of pieces with varying lengths is contemplated herein.

As illustrated in FIGS. 6A-6D, the front panel 20S may have a first pattern on a first side 21S and may have a second pattern on a second side 22S opposite to the first side 21S. Similarly, the back panel 30S may have a third pattern on a first side 31S and may have a fourth pattern on a second side 32S opposite to the second side 31S. When assembling a skirt 10S, a user may selectively determine whether to use the first or second side 21S, 22S, 31S, 32S of the respective panels 20S, 30S. For example, the user may attach the front panel 20S and the back panel 30S with the first side 21S of the front panel 20S facing outward and the first side 31S of the back panel 30S facing outward. As discussed further below, because the front panel 20S and rear panel 30S are reversible, the user may alternatively attach the front panel 20S and the back panel 30S with the second side 22S of the front panel 20S facing outward and the second side 32S of the back panel 30S facing outward. In some embodiments, the first pattern and the third pattern may be generally the same and the second pattern and the fourth pattern may be generally the same. As such, when the skirt 10S is assembled with the first side 21S of the front panel 20S facing outward and the first side 31S of the back panel 30S facing outward, the skirt 10S may have a uniform or substantially uniform pattern. In other embodiments, the first pattern, the second pattern, the third pattern, and the fourth pattern may all be distinct. As such, in any configuration, the outward facing pattern of the front panel 20S and the outward facing pattern of the back panel 30S may be different. As further illustrated in FIG. 9, the first side 21S of the front panel 20S may face outward and the second side 32S of the back panel 30S may face outward, or the second side 22S of the front panel 20S may face outward and the first side 31S of the back panel 30S may face outward. As such, with one front panel 20S and one back panel 30S, at least four distinct aesthetic looks may be achieved. Thus, the user may interactively determine the aesthetic appearance of the skirt 10S by altering the configuration of the front and back panels 20S, 30S without mutilating or otherwise damaging the skirt 10S. Further, the user may use additional front and back panels 20S, 30S that may be attached to respective back and front panels 30S, 20S, creating an even wider variety of aesthetic looks with each front or back panel 20S, 30S that is available for use in assembling a skirt 10S.

Figure 3A:
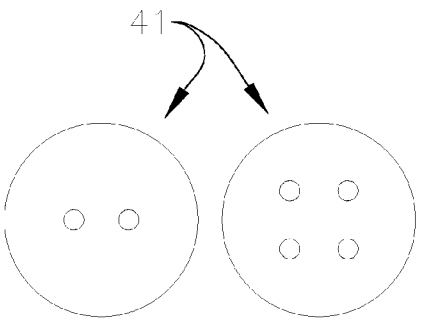
FIG. 3A is a front view of some example buttons that may be used as means for fastening according to one or more embodiments of the present disclosure.
Figure 5B:
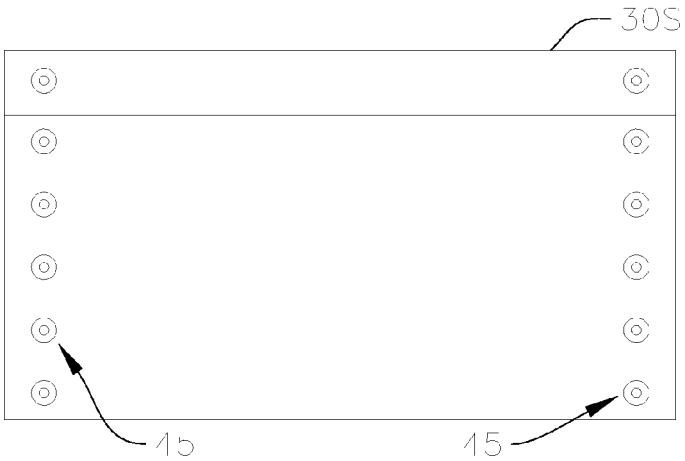
FIG. 5B is a front elevation view of a back panel of a skirt according to one or more embodiments of the present disclosure.
Figure 5A:
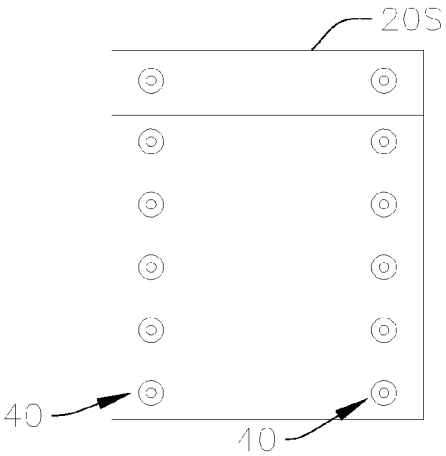
FIG. 5A is a front elevation view of a front panel of a skirt according to one or more embodiments of the present disclosure.
Figure 3B:
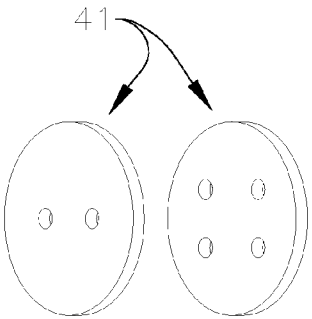
FIG. 3B is a side view of the buttons of FIG. 3A.
Figures 6A, 6B, 6C, 6D:
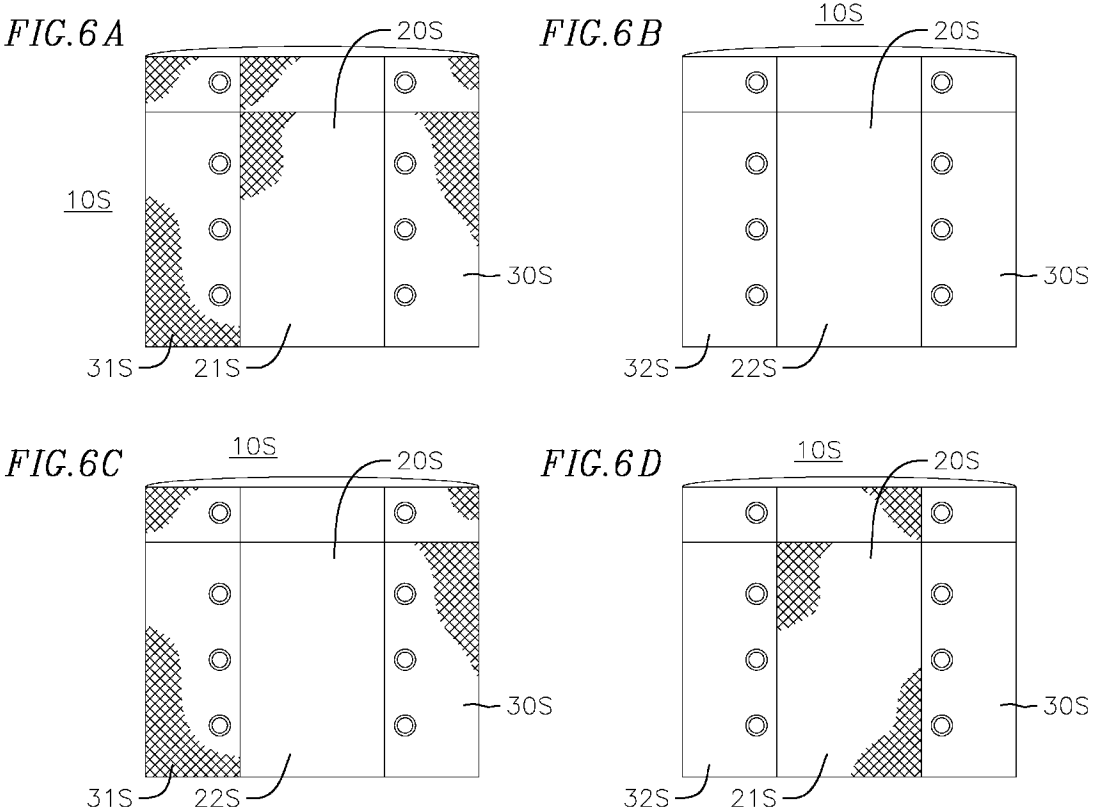
FIGS. 6A-6D are front elevation views of a skirt according to one or more embodiments of the present disclosure.
Figure 7B:
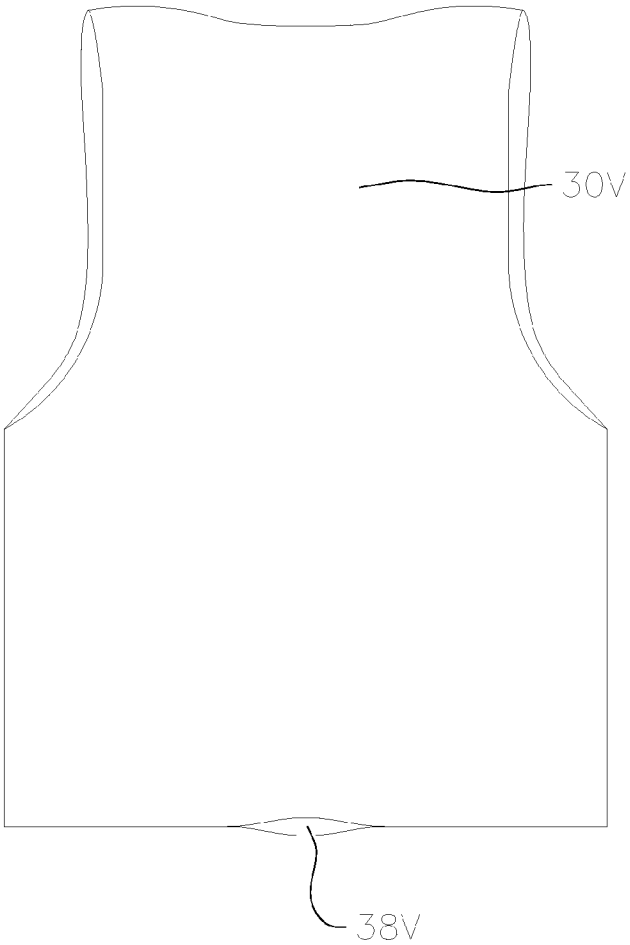
FIG. 7B is a back elevation view of a vest according to one or more embodiments of the present disclosure.
Figure 7A:
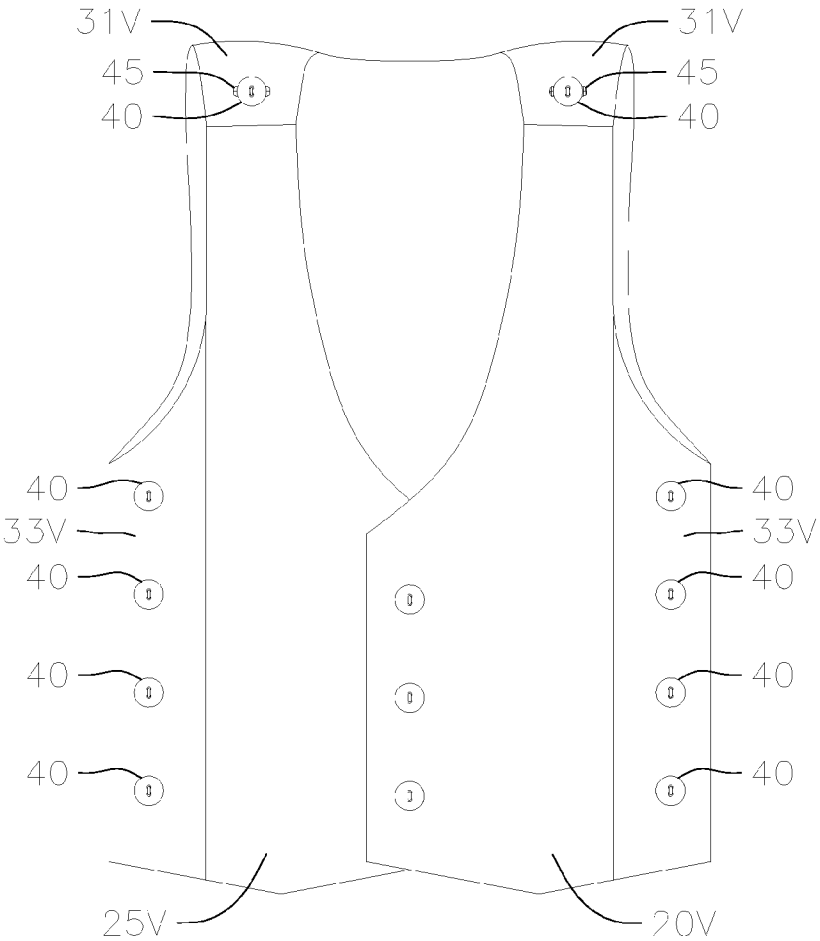
FIG. 7A is a front elevation view of a vest according to one or more embodiments of the present disclosure.

As discussed above, the front panel 20S and the back panel 30S are each reversible or flippable. In some embodiments, the front panel 20S may include one or more fasteners 40, for example, the front panel 20S may include one or more buttons 41 (see FIGS. 3A and 3B). The one or more buttons 41 may be attached on the first side 21S and the second side 22S of the front panel 20S. The one or more buttons 41 may be attached along or near an outer edge (e.g., a right edge) of the front panel 20S and along or near an opposite outer edge (e.g., a left edge) of the front panel 20S. In embodiments having a plurality of buttons 41 on the first side 21S and a plurality of buttons of the second side 22S, the buttons 41 may be positioned in a generally straight line and may be spaced apart from each other in the length direction (e.g., may be equally spaced apart from each other in the length direction). Similarly, in some embodiments, the back panel 30S may include one or more complementary fasteners 45, for example, the back panel 30S may include one or more slits or holes 46. Each slit 46 may extend through the back panel 30S as a through-hole. Each slit 46 may correspond to a button 41 on either side 21S or 22S of the front panel 20S. As such, regardless of whether the first side 31S or the second side 32S of the back panel 30S faces outward, the buttons 41 on the front panel 20S may be aligned with and inserted through a corresponding slit 46 on the back panel 30S. Further, regardless of whether the first side 21S or the second side 22S of the front panel faces outward, the outward facing buttons 41 of the front panel 20S may be inserted through a corresponding slit 46 on the back panel 30S. The alignment or placement of the buttons 41 may be dependent upon the size of the user and the length of the skirt, so as to prevent exposed gaps around or near the buttoned area (e.g., in an area wherein the front panel 20S and the back panel 30S overlap). For example, in embodiments with a relatively large front panel 20S and a relatively large back panel 30S, the buttons 41 may be relatively large to maintain a proportional appearance, and in embodiments with a relatively small front panel 20S and a relatively small back panel 30S, the buttons 41 may be relatively small to maintain a proportional appearance. In some embodiments, the front panel 20S may have four buttons 41 evenly spaced apart from one another on each side edge. As such, each front panel 20S may include a total of sixteen buttons 41, with four buttons 41 on the right edge of the first side 21S, four buttons 41 on the left edge of the first side 21S, four buttons 41 on the right edge of the second side 22S, and four buttons 41 on the left edge of the second side 22S.

The buttons 41 may vary in size; for example, in some embodiments the buttons 41 may have a diameter from about ⅛ inch to about 2 inches. However, in other embodiments, the buttons 41 may be larger than 2 inches or may be smaller than ⅛ inch. The slits 46 may have corresponding sizes to allow for secure placement and alignment of the corresponding buttons 41. In some embodiments, the buttons 41 on any particular front panel 20S may all have the same size. In some embodiments, each button 41 may be sewn onto the front panel 20S at a location between about 2 inches and about 4 inches in the width direction from the edge of the front panel 20S. However, the buttons 41 may be located closer than 2 inches or may be located further than 4 inches from the respective edge of the front panel 20S to meet design requirements.

In some embodiments, the front panel 20S may include slits 46 and the back panel 30S may include corresponding buttons 41. In other words, the fastener 40 and the complementary fastener 45 may be any suitable complementary means for fastening. As such, a male counterpart may correspond to the fastener 40 and a female counterpart may correspond to the complementary fastener 45, or a female counterpart may correspond to the fastener 40 and a male counterpart may correspond to the complementary fastener 45.

The buttons 41 and the slits 46 may be permanently (or substantially permanently) formed in the corresponding front panel 20S and the back panel 30S. In other words, in some embodiments, removal of the buttons 41 from the front panel 20S or modification of the slit 46 on the back panel 30S would mutilate or otherwise damage or alter the front panel 20S.

According to the present disclosure, the fastener 40 and complementary fastener 45 may be any suitable means for fastening. For example, as illustrated in FIGS. 4A, 4B, 5A and 5B, and as will be appreciated by one of ordinary skill in the art, different means for fastening may be used as the fasteners 40 and 45, such as zippers, loop and hook enclosures, snap tape, adhesive fabric tape, studs, buckles, snaps, clasps, grommets and eyelet holes for threading ribbon, string, cording, etc. It will also be appreciated by one of ordinary skill in the art that the fasteners 40 and 45 may be any suitable shape, size, color, etc. For example, although the buttons 41 are illustrated as being round in FIGS. 3A and 3B, the buttons 41 may be square, triangular, oblong, etc. without deviating from the spirit and scope of the invention. Similarly, the buttons 41 can be of sewn 2-hole, 4-hole, or any other suitable configuration type that allows for fastening the front panel 20S and the back panel 30S together. As illustrated in FIGS. 6A-6D, because the width W1 of the front panel 20S is less than the width W2 of the back panel 30S, the fastener 40 and/or complementary fastener 45 are visible from a front-view perspective. As such, the fastener 40 and/or complementary fastener 45 may contribute to the overall aesthetic appeal of the skirt 10S.

Figures 2A, 2B:
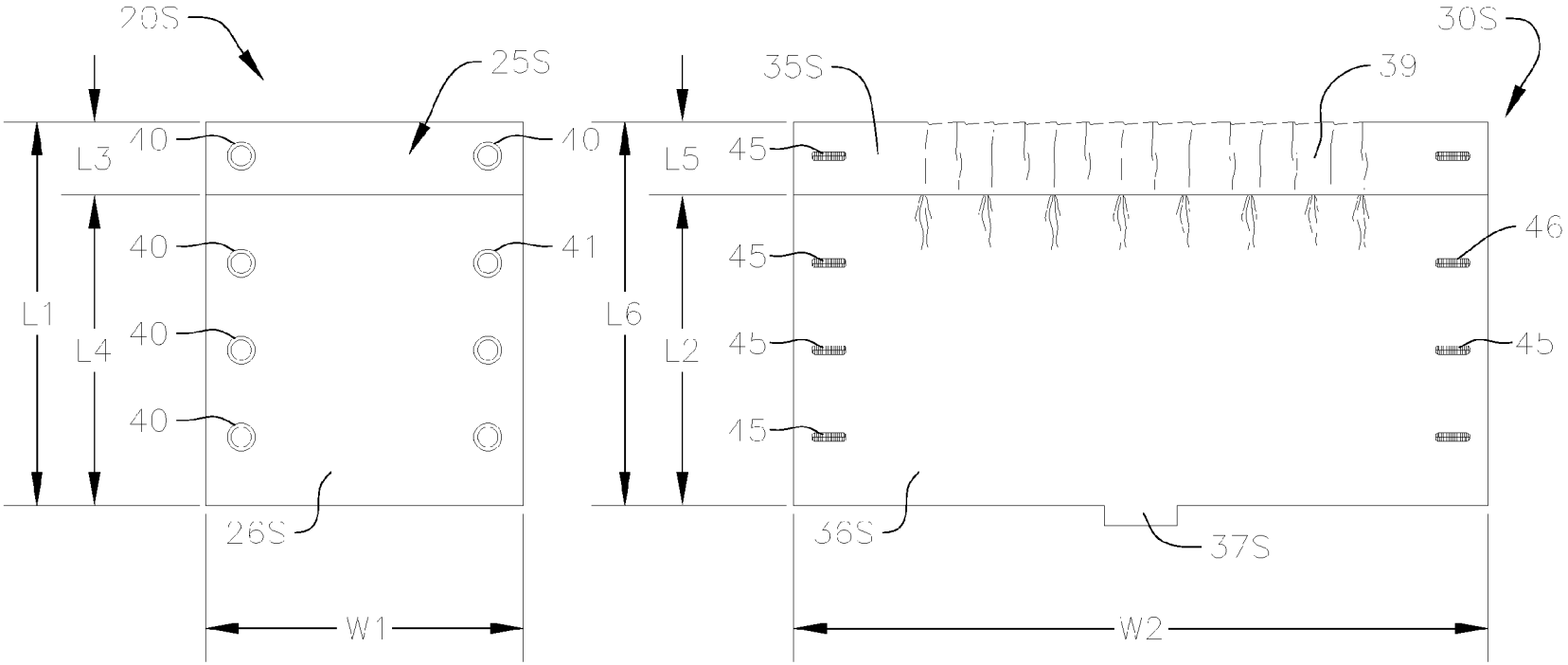
FIG. 2A is a front elevation view of a front panel of a skirt according to one or more embodiments of the present disclosure.
FIG. 2B is a front elevation view of a back panel of a skirt according to one or more embodiments of the present disclosure.
Figure 4B:
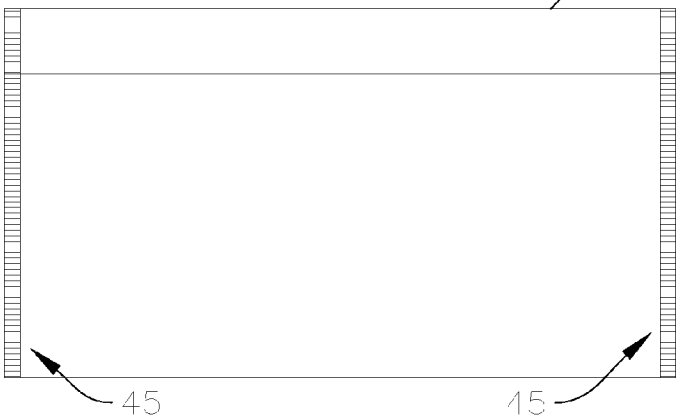
FIG. 4B is a front elevation view of a back panel of a skirt according to one or more embodiments of the present disclosure.
Figure 4A:
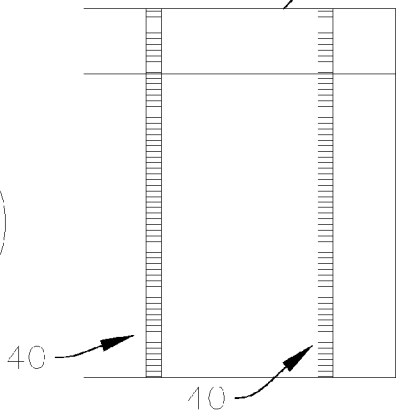
FIG. 4A is a front elevation view of a front panel of a skirt according to one or more embodiments of the present disclosure.

As illustrated in FIGS. 2A and 2B, in some embodiments the front panel 20S may include a front waistband 25S and a front body 26S. Similarly, the back panel 30S may include a back waistband 35S and a back body 36S. The front waistband 25S and the front body 26S may both have the same width W1 and the back waistband 35S and the back body 36S may both have the same width W2. The front waistband 25S may have a length L3 in the length direction, the back waistband 35S may have a length L5 in the length direction, the front body 26S may have a length L4 in the length direction and the back body 36S may have a length L6 in the length direction. The length L3 and the length L5 may be equal or substantially equal, and the length L4 and the length L6 may be equal or substantially equal.

In some embodiments, the fastener 40 and the complementary fastener 45 may be located on the front waistband 25S and the front body 26S and the back waistband 35S and the back body 36S, respectively. For example, in embodiments wherein the fastener 40 includes a plurality of buttons 41, one or more buttons 41 may be on the front waistband 25S, and one or more buttons 41 may be on the front body 26S, with corresponding slits 46 on the back waistband 35S and the back body 36S.

In some embodiments, the back waistband 35S may include elastic 39 sewn inside the back waistband 35S. The elastic 39 may have a length in the length direction that is less than the length L3 of the back waistband 35S. In some embodiments, the elastic 39 may have a length in the length direction of approximately one inch. However, the length of the elastic 39 may be greater or smaller than one inch. The elastic 39 may have a width in the width direction that is less than or equal to the width W3 of the back waistband 35S.

Figure 1A:
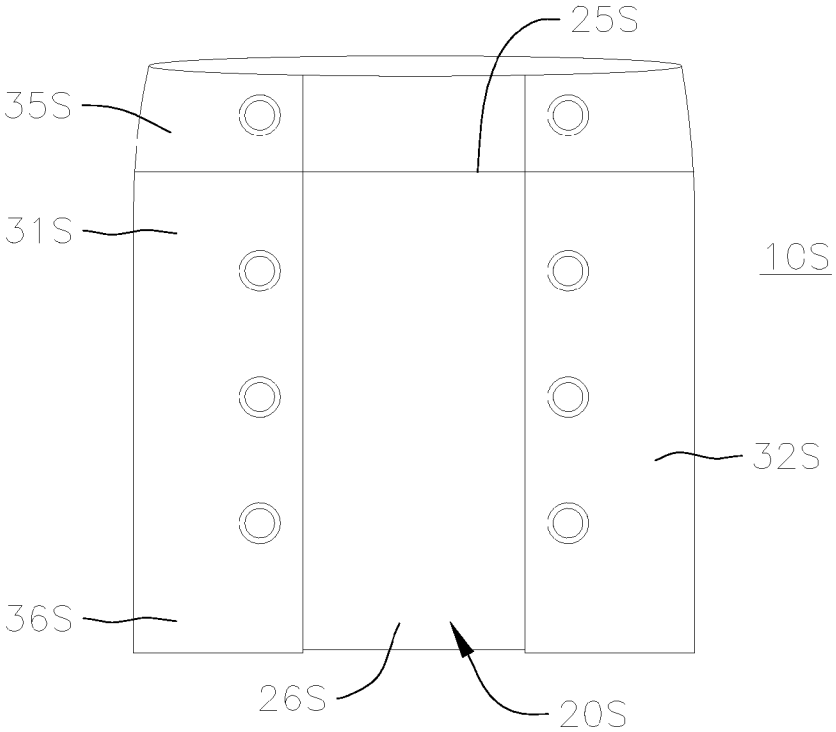
FIG. 1A is a front elevation view of a skirt according to one or more embodiments of the present disclosure.

In some embodiments, the back body 36S may include a pocket 38S positioned at a bottom edge of the back panel 30S, as illustrated in FIG. 1B. The pocket 38S may be formed by making a tab 37S during construction of the back body 36S (see FIG. 2B). As is known in the art, in order to provide an article of clothing that may be worn reversibly, a first layer of fabric with a first pattern or material is sewn to a second layer of fabric with a second pattern or material. For clean seam lines in such a reversible garment, two pieces of fabric may be sewn together along three edges from an "inside out" perspective, then turned "outside out" so that the rough edges are inside of the two pieces of fabric. The fourth edge is then sewn. When the back body 36S includes the tab 37S, once the back body 36S is turned "outside out," the tab 37S may be folded inside the back panel 30S to form the pocket 38S. The pocket 38S may fold inside the back panel 30S to create the appearance of a straight or substantially straight bottom hem line. The pocket 38S may be used to house a manufacturer's care tag, a size tag, or any other desired markings. In some embodiments, the tab 38S may be approximately two inches by two inches to allow for placement of the manufacturer's care tag or other tag. However, the dimensions and various applications of the pocket 38S are not limited thereto. Because the pocket 38S is folded inside the back panel 30S, thereby creating the appearance of a straight or substantially straight bottom hemline, a manufacturer's tag may be affixed to the skirt 10S while remaining concealed in any configuration of the skirt 10S.

In some embodiments, the materials or fabrics used may be tightly or finely woven. During construction, the materials may be placed with the "right" sides together, permanently stitched and then turned such that the right sides face outward. This technique allows for a cleanly sewn and finished edge garment when turned. In other embodiments, for example when the materials or fabrics used are loosely woven or have a non-existent weave, during construction the materials may be placed together with the "wrong" sides together, and edge stitched along each side and bottom of construction pattern pieces. This technique allows for a deliberately frayed, shredded or raveled edging effect.

Embellishments such as lace, cording, edging, and other such items may be sewn into the seams of the front body 26S or back body 36S and the front waistband 25S and the back waistband 35S to allow for added decorative features to the garment.

According to a method of assembling the skirt 10S, a user may first select the back panel 30S that the user desires to wear. The user may then align the back waistband 35S at or near the user's hips along the user's backside, with the back body 36S extending downward (i.e., toward the user's knees). The user may then select and place the front panel 20S at or near the user's hips along the user's frontside, with the front body 26S extending downward. The user may then wrap the ends of the back panel 30S so that the complementary fasteners 45 align with the fasteners 40 on the front panel 20S. The user may fasten the fasteners 40 and 45, creating a completed skirt 10S. Alternately, the user may assemble the skirt 10S prior to aligning the garments with the user's body. As discussed above, during assembly, the user may choose to wear the front panel 20S with the first side 21S facing outward and the back panel 30S with the second side 32S facing outward, or may reverse each individual panel in any desired way. After assembling the skirt 10S, the user may disassemble the skirt 10S (i.e., may detach the panels 20S, 30S) flip one or both of the panels 20S, 30S and refasten the panels 20S, 30S to assemble the skirt 10S, creating a distinct aesthetic look.

As discussed above, each component of the skirt 10S is designed for assembly with a particular component and has a particular alignment. For example, the back panel 30S includes the elastic 39 in the back waistband 35S. Further, the back panel 30S and the front panel 20S have different fasteners 40, 45 that are complementary, but not identical. As such, a back panel 30S could not be mated with another back panel 30S, nor could a front panel 20S be mated with another front panel 20S. Similarly, a back panel 30S would not be appropriately positioned in the location of a front panel 20S, as the user would likely need elastic expansion in the back waist area and not in the front waist area.

In some embodiments of the present invention, the garment, including the skirt 10S, is not uniform. For example, the width W2 of the back panel 30S and the width W1 of the front panel 20S will not typically be equal. As such, the fasteners 40, 45 are incorporated into the aesthetic look of the garment, as they will typically be forward facing instead of hidden at a typical side seam line. Further, even in embodiments wherein the width W2 and the width W1 are equal, or substantially equal, the elastic 39 in the back panel 30S may help to distinguish between the front panel 20S and the back panel 30S, ensuring each component is properly positioned.

The inventive concept, as discussed above with respect to the skirt 10S is readily applied to any garment. However, to enhance clarity, reference is made herein to various features of a vest 10V according to one or more embodiments of the present disclosure. Because each embodiment applies the same or similar features, a detailed description of features discussed above may be omitted in description of subsequent embodiments. However, it will be appreciated by one of ordinary skill in the art that the features described above are applicable to any garment and are not limited to the skirt 10S, nor are they limited to the vest 10V, discussed below.

Referring to FIGS. 7A, 7B and 8A-C, the vest 10V includes a first front panel 20V, a second front panel 25V, and a back panel 30V. The first front panel 20V and the second front panel 25V each include a fastener 40 and the back panel 30V includes complementary fasteners 45. The fasteners 40 on the front panels 20V, 25V may be mated with the complementary fasteners 45 on the back panel 30V to form the assembled vest 10V. The first front panel 20V may further include an additional fastener 43 and the second front panel 25V may further include an additional complementary fastener 44 that mates with the fastener 43 on the first front panel 20V.

Figure 8B:
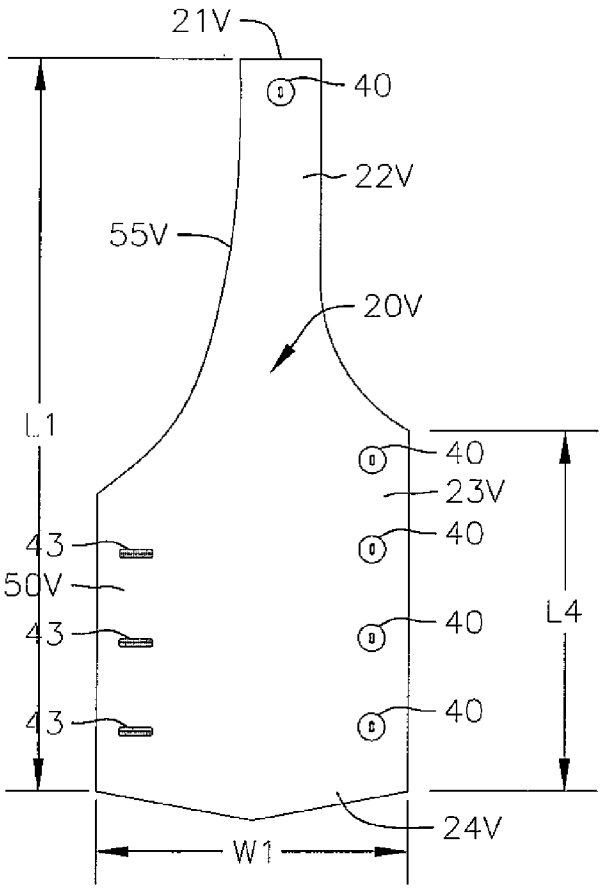
FIG. 8B is an elevation view of a right front panel of a vest according to one or more embodiments of the present disclosure.
Figure 8A:
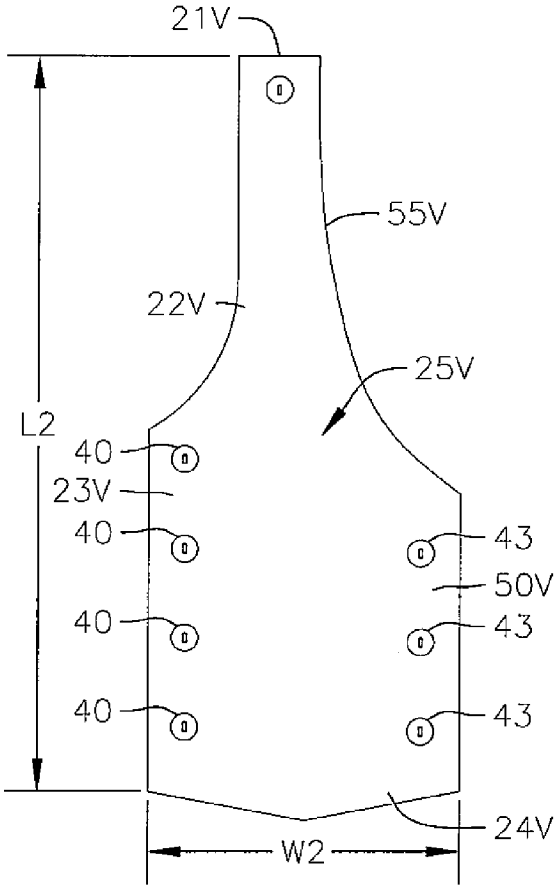
FIG. 8A is an elevation view of a left front panel of a vest according to one or more embodiments of the present disclosure.
Figure 8C:
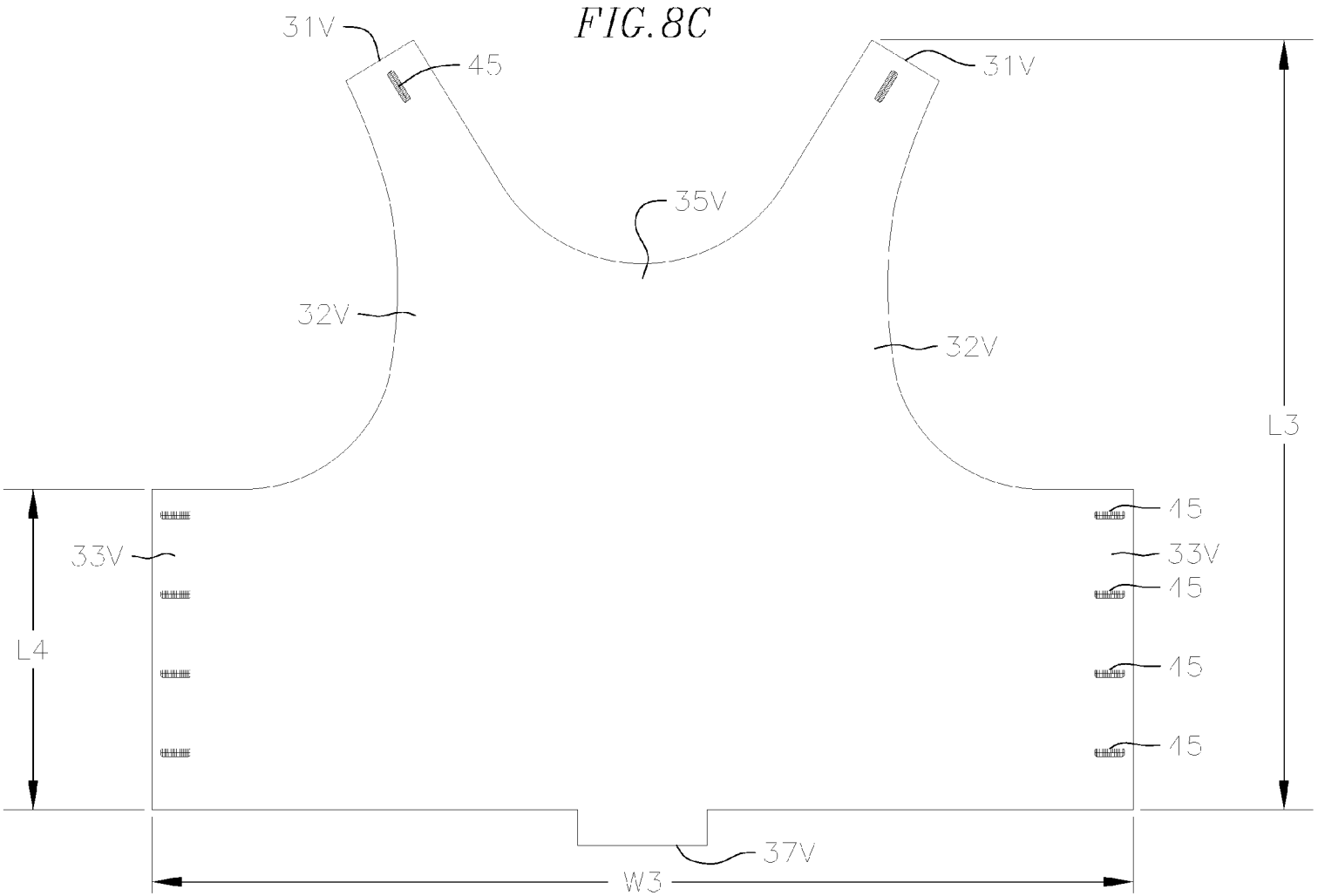
FIG. 8C is an elevation view of a back panel of a vest according to one or more embodiments of the present disclosure.

The first front panel 20V has a first side and a second side opposite the first side, and the second front panel 25V has a third side (i.e., a first side of the second front panel 25V) and a fourth side (i.e., a second side of the second front panel 25V) opposite the third side. As illustrated in FIGS. 8A-8C, the first front panel 20V and the second front panel 25V may each have a shape that is a mirror image of the other front panel. In other words, when the first side of the first front panel 20V is facing outward and the first side of the second front panel 25V is facing outward, the front panels 20V, 25V are mirrored. However, if the first front panel 20V is flipped or reversed, such that the second side of the front panel 20V is facing outward and the first side of the second panel 25V remains facing outward, the front panels 20V and 25V would have the same (or generally the same) shape. As discussed further below, when the first side of the first front panel 20V faces outward and the first side of the second side panel 25V faces outward, the first front panel 20V may be used as a right side panel and the second front panel 25V may be used as a left side panel. However, when the second side of the first front panel 20V faces outward the second side of the second side panel 25V faces outward, the first front panel 20V may be used as the left side panel and the second front panel 25V may be used as the right side panel.

As illustrated in FIGS. 8A-C, the back panel 30V may be generally symmetrical about a vertical center-line. Each front panel 20V, 25V may include a shoulder portion 21V, an arm portion 22V, an outer edge portion 23V, a bottom edge portion 24V, an inner edge portion 50V, and a neck portion 55V. The back panel 30V may include two shoulder portions 31V, two arm portions 32V, two outer edge portions 33V, a bottom edge portion 34V, and a neck portion 35V.

The first front panel 20V may have a width W1 in a width direction and a length L1 extending from the shoulder portion 21V to the bottom edge portion 24V in a length direction. The second front panel 25V may have a width W2 in the width direction and a length L2 extending from the shoulder portion 21V to the bottom edge portion 24V. The lengths L1 and L2 may be equal or substantially equal. In some embodiments, the widths W1 and W2 may be equal or substantially equal. The back panel 30V may have a width W3 extending between the outer edge portions 33V in the width direction and a length L3 extending from the shoulder portion 31V to the bottom edge portion 34V. The width W3 of the back panel 30V is greater than the widths W1 or W2 of either front panel 20V, 25V. The length L3 may be greater than the lengths L1 or L2 of either front panel 20V, 25V. The outer edge portions 33V of the back panel 30V and the outer edge portions 23V of the front panels 20V, 25V each have a length L4 extending in the length direction. The bottom edge portions 24V, 34V may be asymmetrical, may be straight, or may be any other suitable shape. However, as noted above, the outer edge portions 23V, 33V have the same (or substantially the same) length L4.

In some embodiments, the width W3 of the back panel 30V is greater than the sum of the widths W1 and W2 of both front panels 20V, 25V. As such, a portion of the back panel 30V (i.e., the outer edge portions 33V) may be folded or wrapped around an adjacent portion of the back panel 30V to contact the corresponding outer edge portions 23V of the front panels 20V, 25V. Similarly, the length L3 of the back panel 30V may be greater than the lengths L1, L2 of either of the front panels 20V, 25V, respectively. As such, a portion of the back panel 30V (i.e., the shoulder portions 31V) may be folded or wrapped around adjacent portions of the back panel 30V to contact the corresponding shoulder portions 21V of the front panels 20V, 25V. Accordingly, from a front view perspective, as illustrated in FIG. 10A, the first front panel 20V, the second front panel 25V, the shoulder portions 31V of the back panel 30V, and the outer edge portions 33V of the back panel may be visible. As illustrated in FIG. 10B, from a rear view perspective, the back panel 30V may be visible.

Once a user has determined his or her measurements, the user may obtain a first front panel 20V, a second front panel 25V, and a back panel 30V each of suitable widths W1, W2, and W3 and lengths, L1, L2, and L3, respectively. In order to properly assemble the vest 10V, the user will select panels 20V, 25V, 30V having the same length L4 of the respective outer edges 23V, 33V so that the vest 10V may be properly aligned and assembled.

As discussed above, the first front panel 20V includes the first side and the second side opposite the first side, and the second front panel 25V includes the third side and the fourth side opposite the first side. Similarly, the back panel 30V may have a fifth side (i.e., a first side of the back panel 30V) and a sixth side (i.e., a second side of the back panel 30V) opposite the fifth side. The first side of the first front panel 20V may have a first pattern and the second side of the first front panel 20V may have a second pattern. Similarly, the first side of the second front panel 25V may have a third pattern, the second side of the second front panel 25V may have a fourth pattern, the first side of the back panel may have a fifth pattern, and the second side of the back panel may have a sixth pattern. When assembling a vest 10V, a user may selectively determine whether to use the first or second side of the respective panels 20V, 25V, 30V. For example, the user may attach the first front panel 20V, the second front panel 25V, and the back panel 30V each with the respective first side facing outward. As discussed further below, because each panel is reversible, the user may alternatively attach the first front panel 20V, the second front panel 25V, and the back panel 30V each with the respective second side facing outward. The user may also choose to reverse the back panel 30V but neither of the front panels 20V, 25V, such that the first sides of the first and second front panels face outward, and the second side of the back panel 30V faces outward, or vice versa.

In some embodiments, the first, third, and fifth patterns may be generally the same and the second, fourth, and sixth patterns may be generally the same. As such, when the vest 10V is assembled with the first front panel 20V, the second front panel 25V, and the back panel 30V each with the respective first sides facing outward, the vest 10V may have a uniform or substantially uniform pattern. In other embodiments, the first, second, third, fourth, fifth, and/or sixth patterns may be distinct. As such, depending on the number of distinct patterns selected for the various patterns, a variety of aesthetic looks may be achieved as any particular garment is flipped or reversed. Thus, the user may interactively determine the aesthetic appearance of the vest 10V by altering the configuration of the front panels 20V, 25V and back panel 30V without mutilating or otherwise damaging the vest 10V. Further, the user may purchase additional front and back panels 20V, 25V, 30V and substitute the new panels for old panels, creating an even wider variety of aesthetic looks with each front or back panel 20V, 25V, 30V that is available for use in assembling a vest 10V.

As discussed above, the front and back panels 20V, 25V, 30V are each reversible or flippable. In some embodiments, the front panels 20V, 25V may include one or more fasteners 40, for example, the first front panel 20V and the second front panel 25V may include one or more buttons 41 along the outer edge portions 23V and the shoulder portions 21V of the respective front panels 20V, 25V. The fasteners 40, e.g., the one or more buttons 41, may be attached on the first sides and the second sides of the front panels 20V, 25V. The one or more buttons 41 may be located along or near the outer edge portions 23V and the shoulder portions 21V of the front panels 20V, 25V. In embodiments having a plurality of buttons 41 on the first sides of the first and second front panels 20V, 25V and a plurality of buttons 41 on the second sides of the first and second front panels 20V, 25V, the buttons 41 may be positioned in a generally straight line and may be equally spaced apart from each other in the length direction at or along the outer edge portions 23V, and a single button 41 may be placed at or along each shoulder portion 21V. Similarly, in some embodiments, the back panel 30V may include one or more complementary fasteners 45, for example, the back panel 30V may include one or more slits or holes 46. Each slit 46 may extend through the back panel 30V as a through-hole. Each slit 46 may correspond to a button 41 on the front panels 20V, 25V. As such, regardless of whether the first side or the second side of the back panel 30V faces outward, the buttons 41 on the front panels 20V, 25V may be inserted through a corresponding slit 46 on the back panel 30V. Further, regardless of whether the respective first sides or the second sides of the front panels 20V, 25V face outward, the outward facing buttons 41 of the front panels 20V, 25V may be inserted through a corresponding slit 46 on the back panel 30V. The alignment or placement of the buttons 41 may be dependent upon the size of the user and the length of the vest, so as to prevent exposed gaps around or near the buttoned area (e.g., at the overlapping respective outer edge portions 23V, 33V). For example, in embodiments with a relatively large back panel 30V and relatively large front panels 20V, 25V, the buttons 41 may be relatively large to maintain a proportional appearance and to adequately enclose the vest 10V, and in embodiments with relatively small front panels 20V, 25V and a relatively small back panel 30V, the buttons 41 may be relatively small to maintain a proportional appearance and to properly enclose the vest 10V. In some embodiments, the front panels 20V, 25V may each have four buttons 41 evenly spaced apart from one another on the respective outer edges 23V. As such, each front panel 20V, 25V may include eight buttons on the outer edge portions 23V, with four buttons 41 on each first side and four buttons 41 on each second side, and two buttons 41 on the shoulder portions 21V, with one button 41 on each first side and one button 41 on each second side. Similarly, the back panel may include eight slits 46 on the outer edge portions 33V, with four slits 46 on each outer edge portion 33V, and two slits on the shoulder portions 31V, with one slit 46 on each shoulder portion 31V.

In some embodiments, the front panels 20V, 25V may include slits 46 and the back panel 30V may include corresponding buttons 41.

The first front panel 20V may also include the fastener 43 on the inner edge portion 50V, and the second front panel 25V may include the complementary fastener 44 on the inner edge portion 50V. The fastener 43 and complementary fastener 44 may be provided on the first and second sides of the respective front panels 20V, 25V. In other words, the first side of the first front panel 20V and the second side of the first front panel 20V may each include the fastener 43, and the first side of the second front panel 25V and the second side of the second front panel 25V may each include the complementary fastener 44. As such, when the front panels 20V, 25V are reversed, the fastener 43 and the complementary fastener 44 may still be mated together. The fastener 43 and the complementary fastener 44 may be any suitable means for fastening, as described above with respect to the fastener 41 and complementary fastener 45. In some embodiments, the fastener 43 may be a plurality of buttons and the complementary fastener 44 may be a plurality of slits, but the present disclosure is not limited thereto, and any suitable means for fastening may be used. In some embodiments, the vest 10V may omit the fastener and complementary fastener 43, 44.

As discussed above, the means for fastening 40, 43 and the complementary means for fastening 45, 44 may be any suitable means for fastening, and may be any suitable size shape, color, etc. In some embodiments, the fastener 40 may not be uniform. For example, the fastener 40 located at the shoulder portions 21V of the front panels 20V, 25V may have a different size, shape, color, or type relative to the fastener 40 located at the outer edge portions 23V of the front panels 20V, 25V. Similarly, the fastener 40 may have a different size, shape, color or type relative to the fastener 43.

In some embodiments, the back panel 30V may include a pocket 38V positioned at a bottom edge of the back panel 30V. The pocket 38V may be formed by making a tab 37V during construction of the back panel 30V. As is known in the art, in order to provide an article of clothing that may be worn reversibly, a first layer of fabric with a first pattern or material is sewn to a second layer of fabric with a second pattern or material. For clean seam lines in such a reversible garment, two pieces of fabric may be sewn together along three edges from an "inside out" perspective, then turned "outside out" so that the rough edges are inside of the two pieces of fabric. The fourth edge is then sewn. When the back panel 30V includes the tab 37V, once the back panel 30V is turned "outside out," the tab 37V may be folded inside the back panel 30V to form the pocket 38V. The pocket 38V may fold inside the back panel 30V to create the appearance of an even (or straight or substantially straight) bottom hem line. The pocket 38V may be used to house a manufacturer's care tag, a size tag, or other desired markings. In some embodiments, the tab 38V may be approximately two inches by two inches to allow for placement of the manufacturer's care tag or other tag. However, the dimensions and various applications of the pocket 38V are not limited thereto. Because the pocket 38V is folded inside the back panel 30V, thereby creating the appearance of an even or straight or substantially straight bottom hemline, a manufacturer's tag may be affixed to the vest 10V while remaining concealed in any configuration of the vest 10V.

In some embodiments, the materials or fabrics used may be tightly or finely woven. During construction, the materials may be placed with the "right" sides together, permanently stitched and then turned such that the right sides face outward. This technique allows for a cleanly sewn and finished edge garment when turned. In other embodiments, for example when the materials or fabrics used are loosely woven or have a none-existent weave, during construction the materials may be placed together with the "wrong" sides together, and edge stitched along each side and bottom of construction pattern pieces. This technique allows for a deliberately frayed, shredded or raveled edging effect.

Embellishments such as lace, cording, edging, and other such items may be sewn into the seams of the front panels 20V, 25V or the back panel 30V to allow for added decorative features to the garment.

According to a method of assembling the vest 10V, a user may first select the back panel 30V that the user desires to wear. The user may then select the first front panel 20V and the second front panel 25V, and align the outer edge portions 23V of the front panels 20V, 25V with the outer edge portions 33V of the back panel 30V, and the shoulder portions 21V of the front panels 20V, 25V with the shoulder portions 31V of the back panel 30V. The user may then wrap the edge portions 33V and the shoulder portions 31V of the back panel 30V so that the complementary fasteners 45 align with the fasteners 40 on the front panel 20S. The user may fasten the fasteners 40 and 45, creating a completed vest 10V. Alternately, the user may align the vest 10V with the user's body to assemble the vest 10V. As discussed above, during assembly, the user may choose to wear the front panel 20V, 25V with the first side of each front panel 20V, 25V facing outward and the back panel 30V with the first side 36V facing outward, or may reverse each individual panel in any desired way. After assembling the vest 10V, the user may disassemble the vest 10V (i.e., may detach the panels 20V, 25V 30V) flip the front panels 20V, 25V and/or the back panel 30V and refasten the panels 20V, 25V, 30V to reassemble the vest 10V while creating a distinct aesthetic look.

As discussed above, each component of the vest 10V is designed for assembly with a particular component and has a particular alignment. For example, the back panel 30V has markedly different dimensions than either of the front panels 20V, 25V. Further, the first front panels 20V, 25V are asymmetrical about a center-line, and therefore once a front panel is flipped, it will be suitable for connection to either the right edge or the left edge of the back panel 30V, but not both edges. Thus, a back panel 30V could not be mated with another back panel 30V, nor could a vest 10V be made solely of front panels 20V, 25V.

Figure 9:
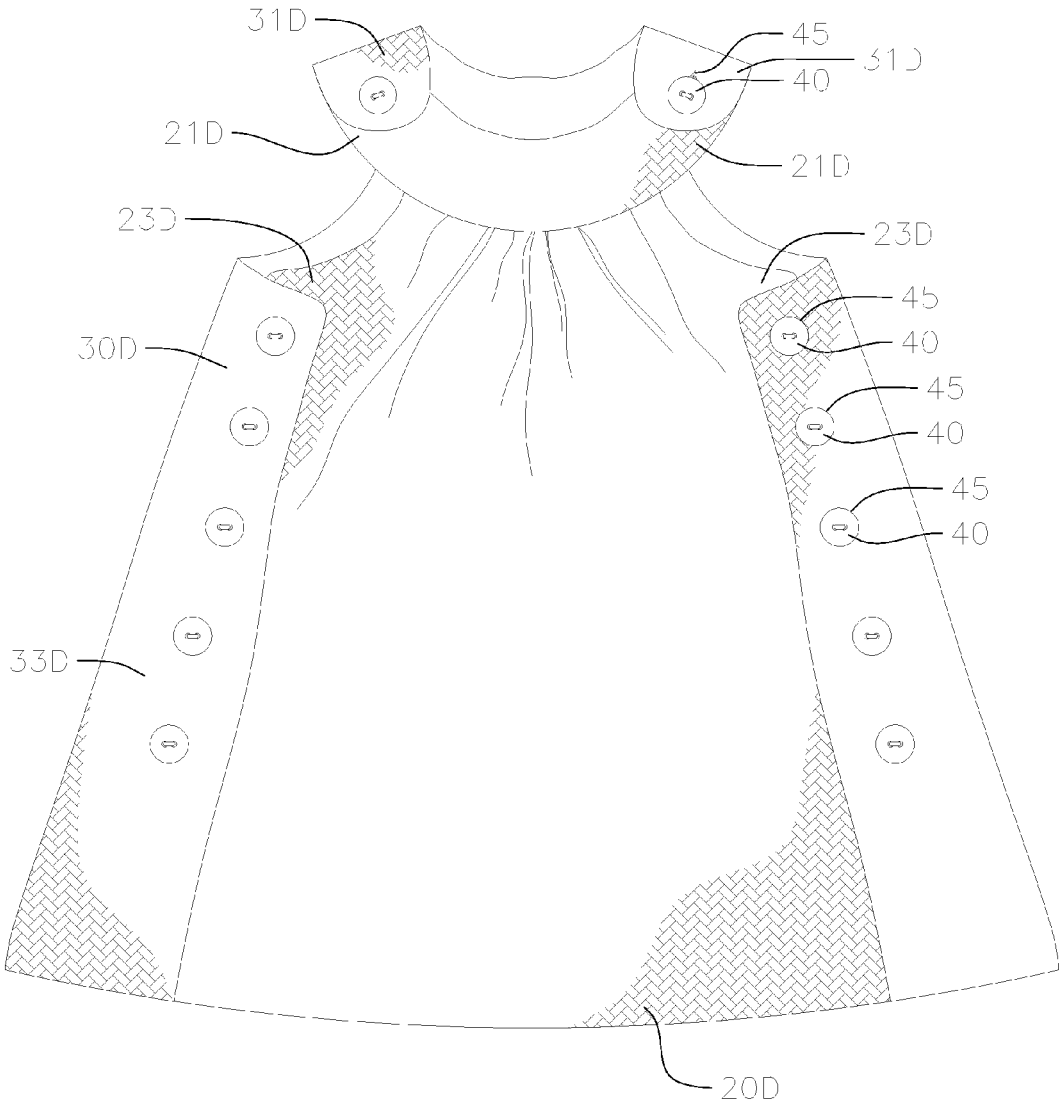
FIG. 9 is a front elevation view of a dress according to one or more embodiments of the present invention.

As illustrated in FIG. 9, embodiments of the present invention are also directed to a dress 10D having a front panel 20D, a back panel 30D, a fastener 40 and a complementary fastener 45. As illustrated in FIG. 9, the front panel 20D and the back panel 30D may be separable and attachable along side edges and at shoulder portions. The fastener 40 may be positioned at or along outer edge portions 23D (e.g., a right side and a left side) and at or along shoulder portions 21D of the front panel 20D. The complementary fastener 45 may be positioned at or along outer edge portions 33D and at or along shoulder portions 31D of the back panel 30D.

Figure 10:
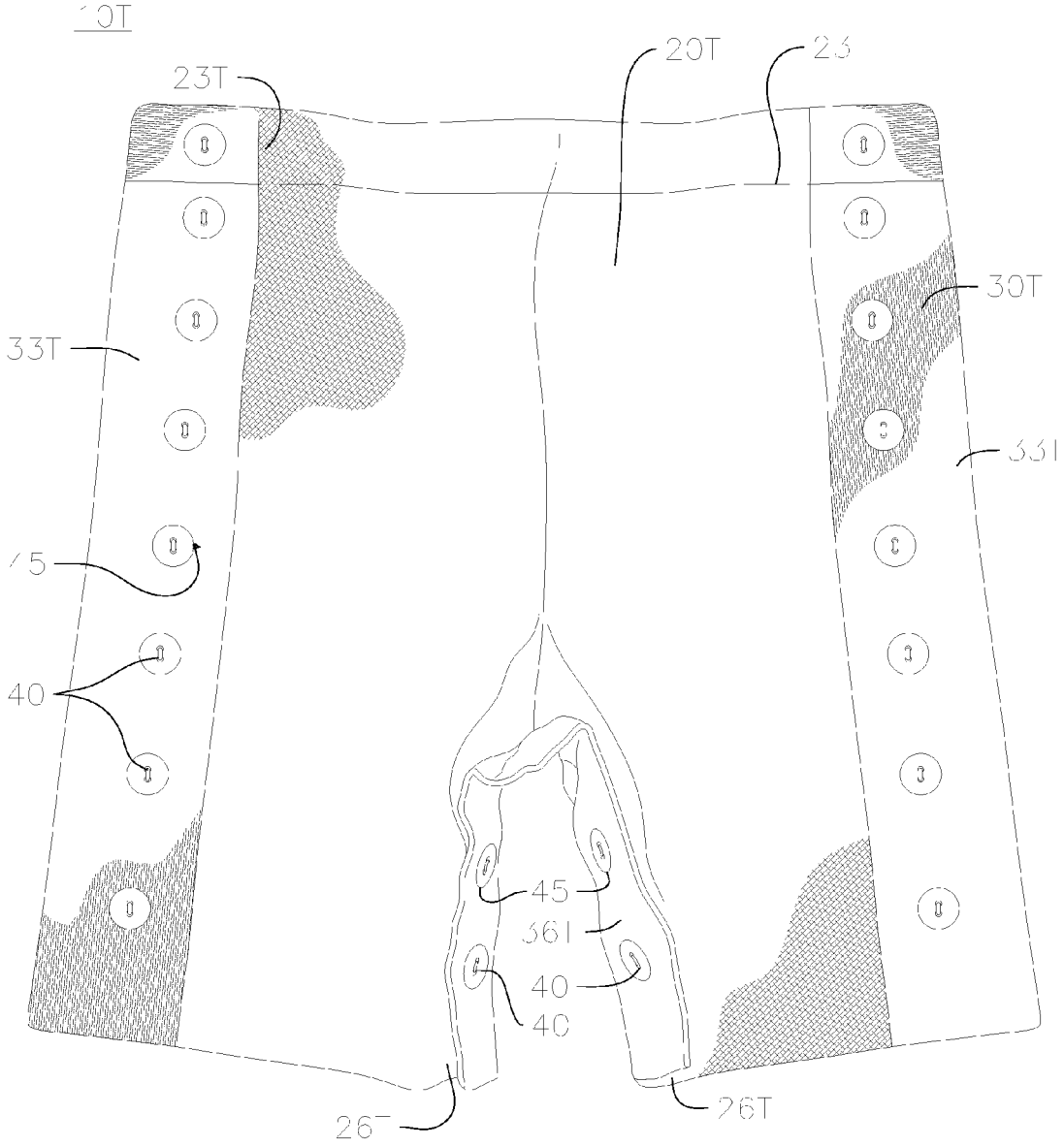
FIG. 10 is a front elevation view of shorts according to one or more embodiments of the present invention.

As illustrated in FIG. 10, embodiments of the present invention are also directed to a pair of shorts 10T having a front panel 20T, a back panel 30T, a fastener 40 and a complementary fastener 45. As illustrated in FIG. 16, the front panel 20T and the back panel 30T may be separable and attachable along inner side edges and along outer side edges. The fastener 40 may be positioned at or along outer edge portions 23T (e.g., a right side and a left side) and at or along inner edge portions 26T (e.g., an inner right side and an inner left side) of the front panel 20T. The complementary fastener 45 may be positioned at or along outer edge portions 33T and at or along inner edge portions 36T of the back panel 30T.

The preceding description has been presented with reference to various embodiments of the present disclosure. Persons skilled in the art to which this disclosure pertains will appreciate that alterations and changes in the described structures and methods of construction can be practiced without meaningfully departing from the principles, spirit, and scope of this disclosure.

While this disclosure has been described in detail with particular references to some exemplary embodiments thereof, the exemplary embodiments described herein are not intended to be exhaustive or to limit the scope of the disclosure to the exact forms disclosed. Persons skilled in the art and technology to which this disclosure pertains will appreciate that alterations and changes in the described structures and methods of assembly and construction can be practiced without meaningfully departing from the principles, spirit, and scope of this disclosure, as set forth in the following claims.

What is claimed is:

1. A detachable garment comprising:

a front panel having a length in a length direction and a width in a width direction and comprising:
- a first outer edge;
- a second outer edge opposite the first outer edge;
- a first side having a first pattern;
- a second side having a second pattern; and
- a fastener located near the first outer edge and the second outer edge of the front panel; and a back panel having a length in the length direction and a width in the width direction and comprising:
- a third outer edge;
- a fourth outer edge opposite the third outer edge;
- a top edge;
- a bottom edge opposite the top edge;
- a third side having a third pattern;
- a fourth side having a fourth pattern; and
- a complementary fastener configured to mate with the fastener and located near the third outer edge and the fourth outer edge of the back panel, wherein the front panel and the back panel are completely separable from each other, wherein the width of the back panel is greater than the width of the front panel, wherein the third outer edge of the back panel is configured to fold over a portion of the back panel to mate the complementary fastener with a respective fastener on the front panel, and wherein the fourth outer edge of the back panel is configured to fold over a portion of the back panel to mate the complementary fastener with a respective fastener on the front panel, such that when the garment is in an assembled configuration, the front panel and the back panel mate to each other at a front-facing side of the garment and the third edge and the fourth edge of the back panel each form a portion of the front-facing side of the garment, wherein the fastener near the first outer edge and the fastener near the second outer edge are of the same type, wherein the bottom edge of the back panel comprises a tab that protrudes away from the bottom edge of the back panel in the length direction, the tab being configured to be folded inside the back panel and toward the top edge of the back panel to form a pocket, wherein the front panel comprises a first front panel and a second front panel, and wherein the first front panel comprises a second fastener along an inner edge of the first front panel and the second front panel comprises a second complementary fastener along an inner edge of the second front panel.

2. The detachable garment of claim 1, wherein the length of the front panel and the length of the back panel are different from each other.

3. The detachable garment of claim 1, wherein the fastener comprises one or more buttons, and the complementary fastener comprises one or more slits.

4. The detachable garment of claim 3, wherein the fastener comprises four buttons on the first side of the front panel and four buttons on the second side of the front panel, and wherein the complementary fastener comprises four slits.

5. The detachable garment of claim 1, wherein the fastener is one selected from the group of zippers, loop and hook enclosures, snap tape, adhesive fabric tape, studs, buckles, snaps, clasps, grommets and eyelet holes for threading ribbon, string, and cording.

6. The detachable garment of claim 1, wherein the fastener comprises a plurality of fasteners that are evenly spaced along an edge of the front panel.

7. The detachable garment of claim 1, wherein the first pattern and the third pattern are the same, and the second pattern and the fourth pattern are the same.

8. The detachable garment of claim 1, wherein the first pattern, the second pattern, the third pattern and the fourth pattern are all different from each other.

9. The detachable garment of claim 1, the front panel comprising a first shoulder portion, and the back panel comprising a second shoulder portion, wherein the fastener is located on the first shoulder portion and the complementary fastener is located on the second shoulder portion to mate with the fastener on the first shoulder portion.

10. The detachable garment of claim 1, wherein when the garment is in the assembled configuration, the third outer edge of the back panel is folded over the first outer edge of the front panel, and the fourth outer edge of the back panel is folded over the second outer edge of the front panel.

11. The detachable garment of claim 1, wherein the width of the front panel is substantially uniform.

12. The garment of claim 1, further comprising a tag that is accommodated in the pocket.

13. A detachable garment comprising:

a front panel having a length in a length direction and a width in a width direction and comprising:

a first outer edge;

a second outer edge opposite the first outer edge;

a first side having a first pattern;

a second side having a second pattern; and a fastener located near the first outer edge and the second outer edge of the front panel; and a back panel having a length in the length direction and a width in the width direction and comprising:

a third outer edge;

a fourth outer edge opposite the third outer edge;

a top edge;

a bottom edge opposite the top edge;

a third side having a third pattern;

a fourth side having a fourth pattern; and a complementary fastener configured to mate with the fastener and located near the third outer edge and the fourth outer edge of the back panel, wherein the front panel and the back panel are completely separable from each other, wherein the width of the back panel is greater than the width of the front panel, wherein the third outer edge of the back panel is configured to fold over a portion of the back panel to mate the complementary fastener with a respective fastener on the front panel, and wherein the fourth outer edge of the back panel is configured to fold over a portion of the back panel to mate the complementary fastener with a respective fastener on the front panel, such that when the garment is in an assembled configuration, the front panel and the back panel mate to each other at a front-facing side of the garment and the third edge and the fourth edge of the back panel each form a portion of the front-facing side of the garment, wherein the fastener near the first outer edge and the fastener near the second outer edge are of the same type, wherein the bottom edge of the back panel comprises a tab that protrudes away from the bottom edge of the back panel in the length direction, the tab being configured to be folded inside the back panel and toward the top edge of the back panel to form a pocket, and wherein a width of the tab in the width direction is two inches and a length of the tab in the length direction is two inches.

14. The detachable garment of claim 13, wherein the front panel further comprises:

a front waistband and a front body, and wherein the back panel further comprises:

a back waistband and a back body.

15. The detachable garment of claim 14, wherein the back waistband comprises elastic and wherein the front waistband does not comprise elastic.

16. The detachable garment of claim 14, wherein the fastener comprises a plurality of fasteners and wherein at least one fastener is located on the front waistband.

17. The detachable garment of claim 13, wherein the fastener comprises a plurality of buttons on the first side of the front panel, wherein the front panel further comprises a front waistband and a front body, wherein one of the buttons from among the plurality of buttons is located on the front waistband near the first outer edge of the front panel, wherein one of the buttons from among the plurality of buttons is located on the front waistband near the second outer edge of the front panel, and wherein remaining ones of the buttons from among the plurality of buttons are located on the front body near the first outer edge or the second outer edge of the front panel.

18. The detachable garment of claim 13, wherein the fastener comprises one or more buttons, and the complementary fastener comprises one or more slits.

19. The detachable garment of claim 13, wherein the fastener is one selected from the group of zippers, loop and hook enclosures, snap tape, adhesive fabric tape, studs, buckles, snaps, clasps, grommets and eyelet holes for threading ribbon, string, and cording.

20. The detachable garment of claim 13, wherein the fastener comprises a plurality of fasteners that are evenly spaced along an edge of the front panel.

* * * * *